US009816756B2

(12) United States Patent
Paderno et al.

(10) Patent No.: US 9,816,756 B2
(45) Date of Patent: Nov. 14, 2017

(54) DRYER OR WASHER DRYER AND METHOD FOR THIS OPERATION

(71) Applicant: WHIRLPOOL CORPORATION, Benton Harbor, MI (US)

(72) Inventors: Jurij Paderno, Novate Milanese (IT); Davide Parachini, Cassano Magnago (IT); Paolo Spranzi, Borgosatollo (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/186,592

(22) Filed: Jun. 20, 2016

(65) Prior Publication Data

US 2016/0289886 A1 Oct. 6, 2016

Related U.S. Application Data

(63) Continuation of application No. 14/258,435, filed on Apr. 22, 2014, now Pat. No. 9,389,018.

(51) Int. Cl.

| | |
|---|---|
| ***D06F 58/24*** | (2006.01) |
| ***F26B 21/08*** | (2006.01) |
| *D06F 58/20* | (2006.01) |

(52) U.S. Cl.
CPC ..... *F26B 21/086* (2013.01); *D06F 58/24* (2013.01); *D06F 58/20* (2013.01)

(58) Field of Classification Search
CPC ..... F26B 21/086; D06F 58/20; D06F 58/24
USPC ..... 34/468, 595, 601
See application file for complete search history.

(56) References Cited

U.S. PATENT DOCUMENTS

| | | | | |
|---|---|---|---|---|
| 2,779,172 A * | 1/1957 | Lindenblad | F24F 5/0042 | 136/203 |
| 4,316,774 A * | 2/1982 | Trusch | B01D 1/00 | 159/DIG. 27 |
| 5,724,750 A * | 3/1998 | Burress | D06F 58/02 | 34/267 |
| 7,526,879 B2 * | 5/2009 | Bae | D06F 58/206 | 34/239 |
| 7,676,954 B2 * | 3/2010 | Classen | A47L 15/0013 | 34/486 |
| 7,975,400 B2 * | 7/2011 | Dittmer | D06F 58/28 | 204/560 |
| 8,365,539 B2 * | 2/2013 | Chen | D06F 58/206 | 62/3.2 |
| 9,157,179 B2 * | 10/2015 | Hartoka | D06F 58/206 | |
| 9,279,212 B2 * | 3/2016 | Atac | D06F 58/02 | |
| 9,389,018 B2 * | 7/2016 | Paderno | F26B 21/086 | |
| 2016/0289886 A1 * | 10/2016 | Paderno | D06F 58/24 | |

FOREIGN PATENT DOCUMENTS

EP 2796613 A1 * 10/2014 ..... F26B 21/086

* cited by examiner

*Primary Examiner* — Stephen M Gravini

(57) ABSTRACT

Example dryers and washer-dryers having a closed process air circuit having a drum, a condenser downstream from the drum for dehumidifying warm moist air, and a thermoelectric device having a cold side arranged in the process air circuit downstream from the drum are disclosed. Example thermoelectric devices have a warm side cooled by a fluid which is circulated in a liquid/air heat exchanger arranged in the process air circuit downstream from the condenser. Using the disclosed architectures, appliance design can be simplified without decreasing overall system performance.

20 Claims, 4 Drawing Sheets

DRYER OR WASHER DRYER AND METHOD FOR THIS OPERATION

RELATED APPLICATION(S)

This application claims priority from European Patent Application No. 13165005.3, filed Apr. 23, 2013, which is incorporated herein by reference in its entirety. This application is also a continuation of and claims priority to U.S. patent application Ser. No. 14/258,435, entitled "DRYER OR WASHER DRYER AND METHOD FOR THIS OPERATION" filed Apr. 22, 2014, currently allowed, which is incorporated herein by reference in its entirety.

BACKGROUND

In conventional dryers and washer-dryers, the use of thermoelectric devices implies exchanging heat on both sides of a planar object thus meaning that process air has to flow in two opposite directions, thereby leading to a complex air path design and to a trade-off between space and performance that may be in practice not acceptable.

SUMMARY

Disclosed example drying appliances (e.g., a dryer, a washer-dryer, a refresher, etc.) having a closed process air circuit including a drum, a condenser downstream from the drum for dehumidifying warm moist air, and a thermoelectric device having a cold side arranged in the process air circuit downstream from the drum are disclosed. Example disclosed thermoelectric devices have a warm side cooled by a fluid which is circulated in a liquid/air heat exchanger arranged in the process air circuit downstream from the condenser.

It is an object of this disclosure to provide drying appliances that do not present the above drawbacks and in which the Peltier thermoelectric module can be used without modifying the traditional process air path of a condenser dryer.

Another object of this disclosure is to provide drying appliances with increased energy efficiency compared to prior art.

The above objects are reached thanks to the features disclosed herein and listed in the appended claims.

The novel dryer architectures disclosed herein solve at least the above problems by simplifying appliance design without decreasing the overall system performance that indeed may take benefit of a reduced pressure drop in the process air circuit.

Another advantage of the appliances disclosed herein is that the energy saving performances are similar to the performance of more expensive condensing dryers with a heat pump device.

BRIEF DESCRIPTION OF THE DRAWINGS

Further advantages and features will become clear from the following detailed description, with reference to the attached drawings in which.

DETAILED DESCRIPTION

Figure 1:
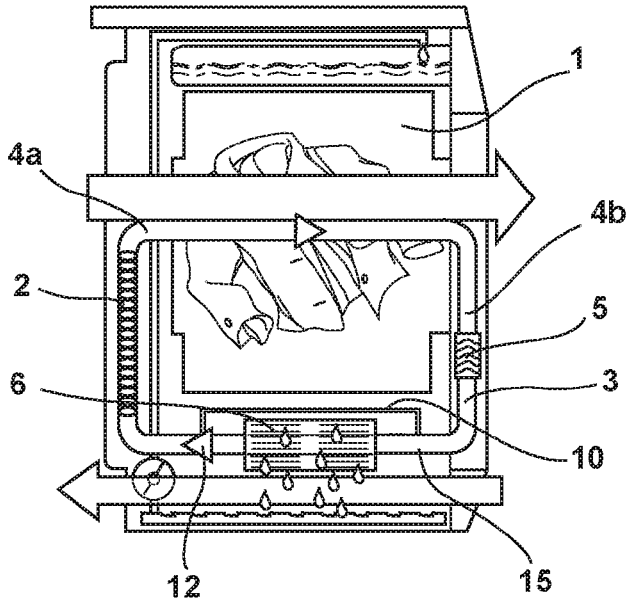
FIG. 1 is a schematic view of an example household tumble dryer according to this disclosure.

With reference to the drawings, an example tumble dryer comprises a rotating drum 1 containing a certain amount of clothes, actuated by an electric motor, a heating element 2 that heats the air going inside, an air channel 3 that conveys the air to a condenser 6 (condensing dryer) which is an air/air heat exchanger, a temperature sensor 4*a* that measures the temperature of the air after the heater 2 before entering the drum 1, a temperature sensor 4*b* measuring the temperature of the exhaust air, and a screen 5 that collects the lint detaching from the tumbling clothes. While the examples disclosed herein refer to a dryer, it should be understood that the disclosed architectures can be used for other drying appliances such as, but not limited to, a washer-dryer, a refresher, etc.

Condenser dryer functionality is based on condensing the evaporated water from the clothes without throwing the humidity directly into the environment as a conventional air vented dryer does. For this reason, condensing dryers normally have a closed loop process air and the humid air, after passing into the drum 1 through the moist clothes, goes into the condenser 6 where the vapor condenses, then the air is heated and returned to the drum 1.

Figure 3:
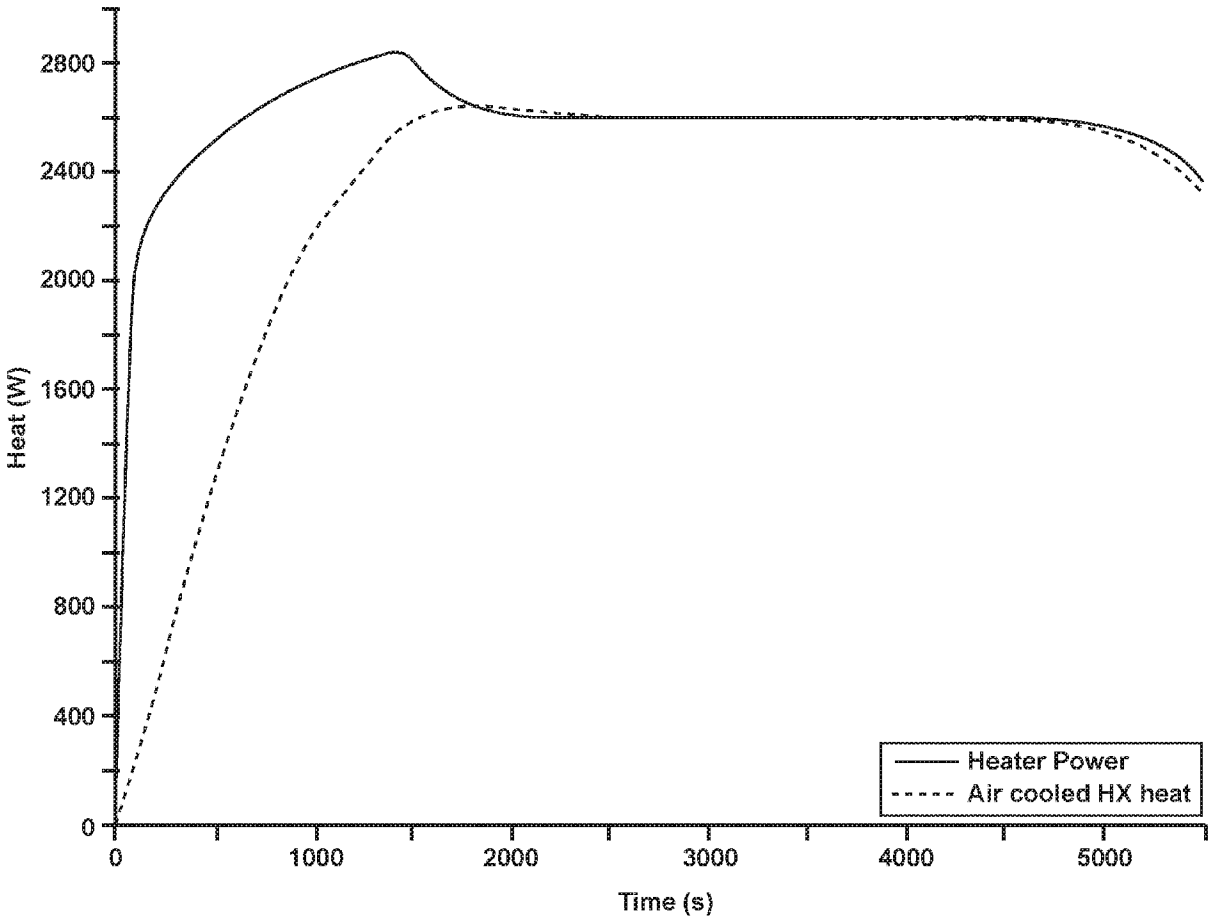
FIG. 3 (PRIOR ART)
FIG. 3 is a graph showing energy balances in a prior-art condensing dryer.

Traditional condensing dryers use an electrical heater to heat the process air in order to evaporate moisture from the clothes, and then release such energy through the process air condenser in the cooling air into the environment. This means almost all energy released for condensing is wasted into the environment and has to be reintroduced into the system to keep the desired temperature operating point by means of the electric heater. An example of such energy balance is shown in FIG. 3, wherein the heat exchanged on the heating element is depicted in the solid line whereas the heat exchanged on the air cooled condenser is shown in the dashed line.

In the examples disclosed herein, the process air circuit includes a thermoelectric device 15 and a liquid/air circuit 10 capable of transferring heat from a warm side 16 of the thermoelectric device 15 to the process air downstream from the condenser 6, by means of a liquid and/or air heat exchanger 12. The cold side 14 of the thermoelectric device 15 is in direct heat exchange relationship with the process air by means of a heat sink 18 in order to cool it downstream or, as in some embodiments, upstream from the condenser 6. The overall architecture of a dryer according to this disclosure is therefore similar to that of a traditional air cooled condensing dryer, however, the thermoelectric device 15 that exchanges heat across the condenser 6, more specifically by cooling the process air upstream (so starting condensation) or downstream (so ending condensation) the air cooled condenser 6 and heating the air downstream from the condenser 6 and upstream from the electric heater 2. By using the example structures, a portion of the condensation energy is transferred by the thermoelectric device 15 from one side to the other side of the condenser 6, so it is not wasted in the ambient.

Figure 2:
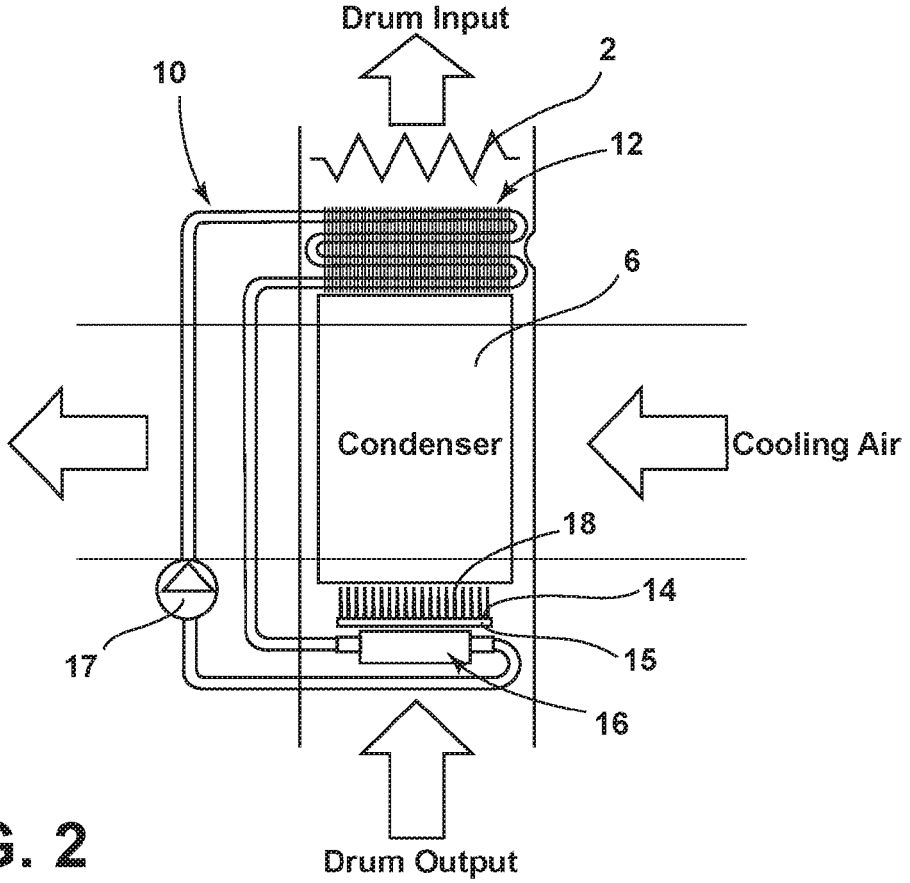
FIG. 2 illustrates a portion of the tumble dryer of FIG. 1 in more detail.

With reference to FIG. 2, the cold side 14 of the thermoelectric device 15 directly exchanges heat through a finned heat sink 18 into the process air channel just downstream from the drum output. In such position the air is close to saturation, so condensation occurs onto the heat sink 18.

The heat removed by the heat sink 18, plus the electrical energy supplied to the thermoelectric device 15 is released to the circulating water passing into a water tank 16 that in a small volume ensures a very high performance and limits the thermoelectric device thermal gradient allowing such device to work at a higher efficiency operating point. The process air leaving the heat sink 18 passes into the condenser 6, where it loses additional water and thermal energy that is released to the cooling air. The heat released to the liquid/water circuit 10 can now be transferred to the process air by means of the heat exchanger 12 before passing through the electric heater 2, that in such system will need to provide less energy to keep the required temperature operating point, thus increasing the overall system efficiency with respect to conventional air cooled only condenser dryers. Moreover the particular architectures proposed herein (cold side of thermoelectric device 15—"TEC"—upstream from the air cooled condenser) allows for lower temperature differences between the two sides of the TEC 15 leading to additional increase in the efficiency of the device.

Figure 4:
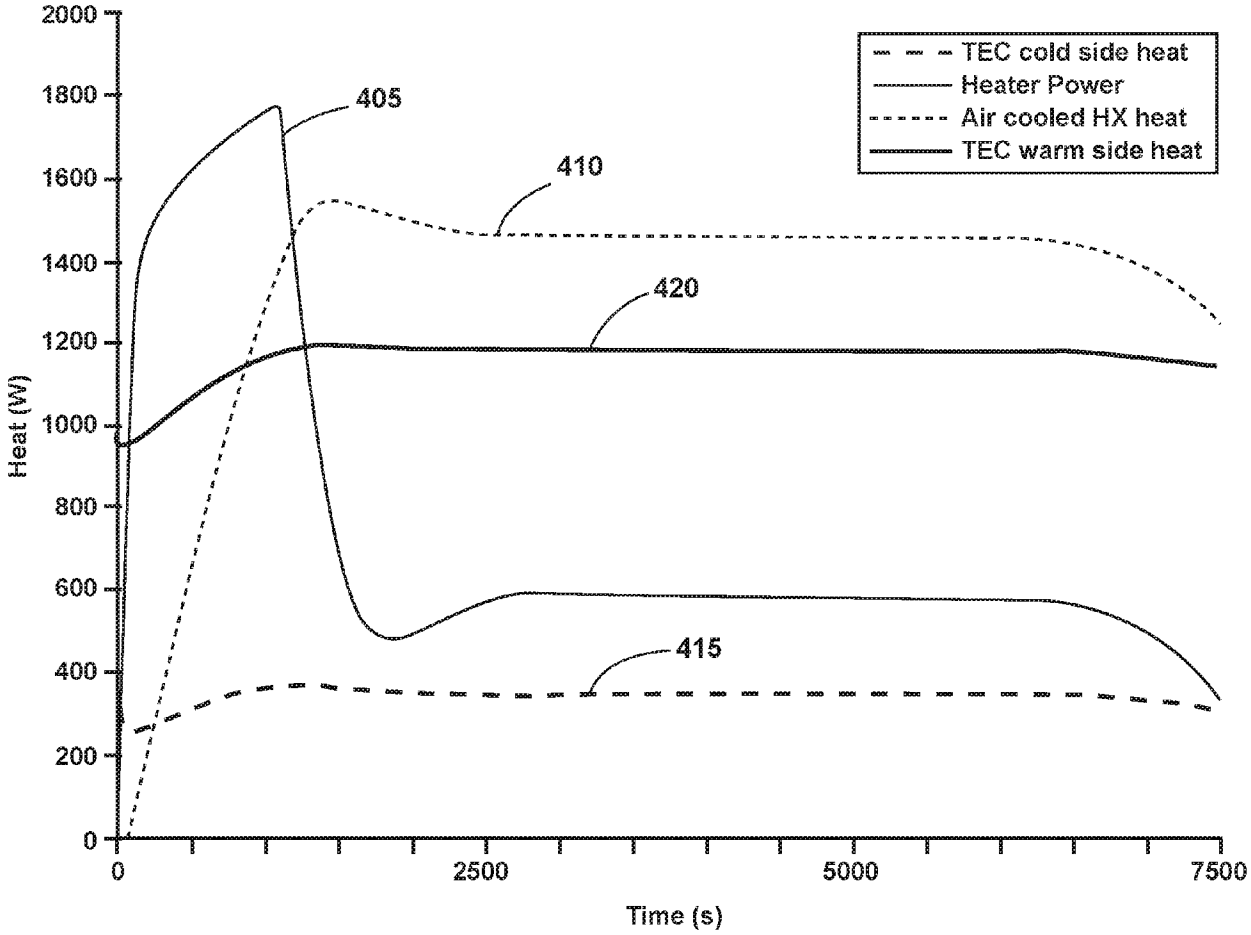
FIG. 4 is a graph showing energy balances in an example dryer according this disclosure.

As a comparison to FIG. 3, in FIG. 4 is shown an example of the energy balance that can be obtained by using the example architectures disclosed herein; the heat exchanged on the heating element is depicted in the solid line 405, the heat exchanged on the air cooled condenser is shown in the dashed line 410, the heat exchanged on cold side of TEC is in the bold dashed line 415, and the heat exchanged on warm side of TEC is in the bold solid line 420. As discussed above, the heat exchanged on warm side of TEC 15 is the sum of electrical power provided to such device and the heat exchanged on cold side 14 to condense water that is therefore not wasted as happens in traditional condensing dryers.

Figure 5:
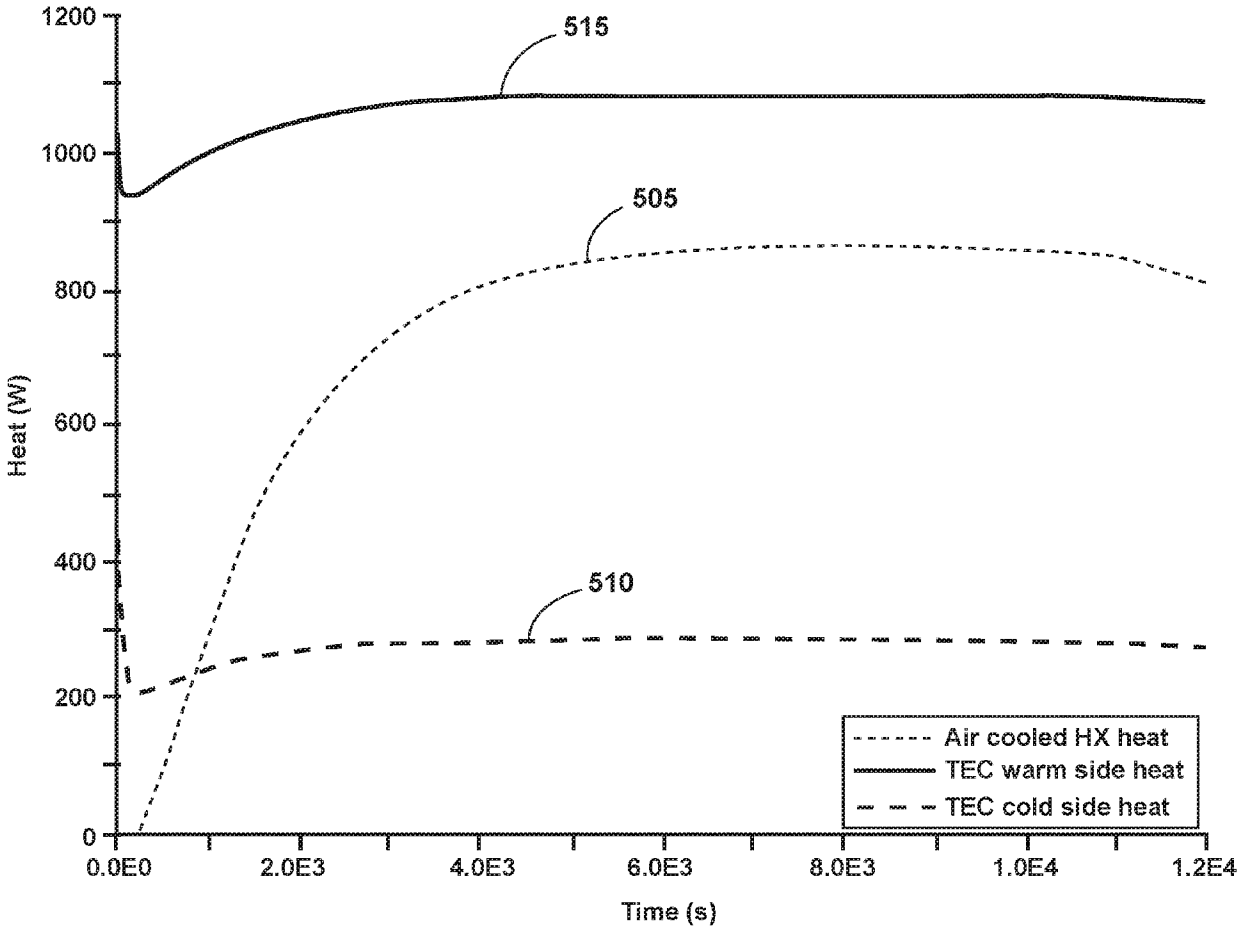
FIG. 5 is a another graph showing energy balances in another dryer according this disclosure not having an electrical heating element in addition to the thermoelectric device.

Another possible embodiment takes into consideration the removal of the electrical heating element. By designing the system in order to keep constant the energy efficiency, the cycle length increases but overall cost of the dryer decreases giving a possible solution for implementing low cost machines. An example of the energy balances that can be obtained in such embodiment is shown in FIG. 5; the heat exchanged on the air cooled condenser is shown in dashed line 505, the heat exchanged on cold side of TEC is in bold dashed line 510, and the heat exchanged on warm side of TEC is in bold solid line 515. As mentioned, this solution has the disadvantage of increasing cycle length but can be implemented with reduced cost.

In the liquid/air circuit 10 water, or a mixture of water and alcohol or glycol ether can be used, and the circulation can be either due to natural convection or forced by a circulation pump 17.

To increase furthermore the heat exchange efficiency, a phase changing liquid (so called "phase changing material" or PCM) at design temperatures can be used taking the benefit of an almost constant temperature heat exchange with high performances; even in this case the circulation can be either due to natural convection or forced by the circulation pump 17.

The liquid/air heat exchanger 12 is preferably provided with fins or similar devices in order to increase the heat transfer coefficient.

What is claimed is:

1. A method for drying articles in an appliance, the method comprising:

providing a drum in a closed process air circuit;

providing a condenser in the closed process air circuit downstream from the drum for dehumidifying warm air;

providing a thermoelectric device having a cold side arranged in the process air circuit downstream from the drum;

providing a first liquid/air heat exchanger arranged in the process air circuit downstream from the condenser;

providing a second liquid/air heat exchanger adjacent a warm side of the thermoelectric device;

providing a closed liquid circuit between the first liquid/air heat exchanger and the second liquid/air heat exchanger;

circulating a fluid between the second liquid/air heat exchanger and the first liquid/air heat exchanger.

2. The method as defined in claim 1, further comprising heating the process air before the process air enters the drum.

3. The method as defined in claim 1, wherein the fluid comprises at least one of water, a mixture of water and an alcohol, and/or a mixture of water and a glycol ether.

4. The method as defined in claim 1, wherein the fluid comprises a phase change material.

5. The method as defined in claim 1, further comprising providing a pump for circulating the fluid.

6. The method as defined in claim 1, wherein the fluid circulates due to convection.

7. The method as defined in claim 1, wherein the first liquid/air heat exchanger comprises a plurality of fins.

8. The method as defined in claim 1, wherein the cold side of the thermoelectric device comprises a plurality of fins.

9. The method as defined in claim 1, wherein the warm side of the thermoelectric device is in heat exchange relationship with a tank that is part of a fluid circulation system.

10. The method as defined in claim 1, wherein the second liquid/air heat exchanger comprises a plurality of fins.

11. The method as defined in claim 1, wherein the first liquid/air heat exchanger comprises a heat sink.

12. The method as defined in claim 1, wherein the cold side of the thermoelectric device comprises a heat sink.

13. A drying appliance having a closed process air circuit comprising:

a drum in the closed process air circuit;

a condenser located in the closed process air circuit downstream from the drum for dehumidifying warm air; and a heat sink arranged in the process air circuit downstream from the drum;

a thermoelectric device having a cold side adjacent the heat sink;

a first liquid/air heat exchanger arranged in the process air circuit downstream from the condenser;

a second liquid/air heat exchanger adjacent a warm side of the thermoelectric device;

a closed liquid circuit connected between the first liquid/air heat exchanger and the second liquid/air heat exchanger for circulating a fluid between the first liquid/air heat exchanger and the second liquid/air heat exchanger;

wherein the warm side of the thermoelectric device is cooled by the fluid circulated in the closed liquid circuit and the process air stream is warmed by the first liquid/air heat exchanger.

14. The drying appliance as defined in claim 13, further comprising a heating element in the process air stream upstream from the drum.

15. The drying appliance as defined in claim 13, wherein the fluid comprises at least one of water, a mixture of water and an alcohol, and/or a mixture of water and a glycol ether.

16. The drying appliance as defined in claim 13, wherein the fluid comprises a phase change material.

17. The drying appliance as defined in claim 13, further comprising a pump for circulating the fluid.

18. The drying appliance as defined in claim 13, wherein the fluid circulates due to convection.

19. The drying appliance as defined in claim 13, wherein the heat sink is arranged in the process air circuit downstream of the condenser.

20. A drying appliance having a closed process air circuit comprising:

a drum in the closed process air circuit;

a condenser located in the closed process air circuit downstream from the drum for dehumidifying warm air; and a heat sink arranged in the process air circuit downstream from the drum and upstream from the condenser;

a thermoelectric device having a cold side adjacent the heat sink;

a first liquid/air heat exchanger arranged in the process air circuit downstream from the condenser;

a second liquid/air heat exchanger adjacent a warm side of the thermoelectric device;

a closed liquid circuit connected between the first liquid/air heat exchanger and the second liquid/air heat exchanger for circulating a fluid between the first liquid/air heat exchanger and the second liquid/air heat exchanger;

wherein the warm side of the thermoelectric device is cooled by the fluid circulated in the closed liquid circuit and the process air stream is warmed by the first liquid/air heat exchanger.

* * * * *